US006102783A

United States Patent [19]

Loock et al.

[11] Patent Number: 6,102,783

[45] Date of Patent: Aug. 15, 2000

[54] APPARATUS FOR MICROFINISHING CAMSHAFT SURFACES

[75] Inventors: Manfred Loock, Sprockhövel; Jens Keller, Wuppertal, both of Germany

[73] Assignee: Ernst Thielenhaus GmbH & Co. KG, Wuppertal, Germany

[21] Appl. No.: 09/228,174

[22] Filed: Jan. 11, 1999

[30] Foreign Application Priority Data

Jan. 13, 1998 [DE] Germany ..... 198 00 885

[51] Int. Cl.[7] ..... B24B 49/00

[52] U.S. Cl. ..... 451/173; 451/168; 451/302; 451/303; 451/307

[58] Field of Search ..... 451/62, 303, 306, 451/307, 302, 296, 162, 164, 168, 173

[56] References Cited

U.S. PATENT DOCUMENTS

| | | | |
|---|---|---|---|
| 4,747,234 | 5/1988 | Weber . | |
| 4,993,191 | 2/1991 | Judge . | |
| 5,371,973 | 12/1994 | Kaiser et al. | 451/62 |
| 5,472,368 | 12/1995 | Zollig | 451/62 |
| 5,507,684 | 4/1996 | Schwar | 451/302 |
| 5,865,669 | 2/1999 | Kiriyama et al. | 451/302 |

FOREIGN PATENT DOCUMENTS

| | | |
|---|---|---|
| 40 15 569 | 5/1991 | Germany . |
| 4015569 | 5/1991 | Germany . |
| 2233586 | 1/1991 | United Kingdom . |
| 2258178 | 2/1993 | United Kingdom . |

*Primary Examiner*—Eileen P. Morgan
*Attorney, Agent, or Firm*—Herbert Dubno; Andrew Wilford

[57] ABSTRACT

An apparatus for finishing a surface of a camshaft extending along an axis with the surface offset from the axis has a drive for rotating the camshaft about the axis, a support displaceable radially of the axis, and a plurality of pusher heads on the support. The heads are movable independently of each other toward and away from the camshaft relative to the support along respective angularly offset pusher axes extending radially of the camshaft. All the pusher heads are biased along the respective pusher axes toward the camshaft axis with substantially the same force.

11 Claims, 4 Drawing Sheets

APPARATUS FOR MICROFINISHING CAMSHAFT SURFACES

FIELD OF THE INVENTION

The present invention relates to a microfinishing apparatus. More particularly this invention concerns an apparatus for microfinishing the bearing and cam surfaces of a camshaft.

BACKGROUND OF THE INVENTION

In order to grind a cam or bearing surface of a camshaft, it is standard to mount the camshaft in a lathe-like support that rotates the camshaft about the camshaft axis which is normally offset from the center of the cam. Abrasive tools, either in the form of abrasive stones directly engaging the cam surface or pusher heads pressing an abrasive band against the cam surface, are pressed generally radially of the axis against the cam surface to hone the surface, often with the addition of a cutting oil to cool the surface and carry off any particles. Since the cam center is offset from the cam axis, this requires the tools to move radially relative to the camshaft axis as they ride around the cam surface. It is also standard to relatively axially reciprocate the camshaft and the tools during such machining.

In the system described in commonly owned German patent 4,015,569 filed May 15, 1990 honing stones are mounted at the outer ends of long support levers whose inner ends are mounted at respective pivots having axes offset well away from and parallel to the camshaft axis. Biasing means engaged between the lever ends press the stones against the cam surface. Such a system has the disadvantage that the movement of the stones is along an arc, albeit a large one, so that the angle of attack of the stones on the surface changes somewhat as the radial spacing of the stone from the camshaft varies. In addition a relatively large mass comprised of the stone and the lever must be displaced in and out at a rate of speed depending on the rotation rate of the camshaft so that in regions where the stone must move radially out the inertia of the assembly increases the pressure exerted by the stone while in regions where the stone must move in rapidly the pressure is decreased. Thus the camshaft must be rotated slowly to reduce this effect, thereby reducing machining speed.

U.S. Pat. No. 4,993,191 of Judge shows another arrangement where two massive pivotal support arms each carry a pair of roller-type pushers that press an abrasive band against the camshaft surface. This system shares most of the disadvantages of the other above-described system.

SUMMARY OF THE INVENTION

An apparatus for finishing a surface of a camshaft extending along an axis with the surface offset from the axis has according to the invention a drive for rotating the camshaft about the axis, a support displaceable radially of the axis, and a plurality of pusher heads on the support. The heads are movable independently of each other toward and away from the camshaft relative to the support along respective angularly offset pusher axes extending radially of the camshaft. All the pusher heads are biased along the respective pusher axes toward the camshaft axis with substantially the same force.

Thus the mass that must move radially of the axis is greatly reduced so the camshaft can be rotated rapidly for quickest possible machining. In addition the movement is purely radial so the angle of attack will not change as the pusher heads move in and out on the cam surface. The pusher heads can be fairly small so that a plurality of them can be clustered about the cam surface, maximizing machining effectiveness by simultaneously machining at several locations.

According to the invention the drive also relatively reciprocates the camshaft and the supports axially relative to the camshaft axis. This can be done by reciprocating the camshaft relative to axially fixed supports, or reciprocating the supports axially relative to the camshaft. Furthermore according to the invention the camshaft has a plurality of such surfaces and the apparatus has for each surface a respective such support each provided with a respective plurality of such pusher heads.

The apparatus in accordance with the invention is further provided with an abrasive band extending between the pusher heads and the surface so that the heads press the band against the surface. This band is advanced periodically to position a fresh section between the pusher heads and the camshaft surface.

The apparatus has a guide extending radially of the camshaft axis and carrying the support. Normally the supports are positioned at the beginning of a machining operation and do not move radially during the operation. Only the pusher heads move.

Each pusher head according to the invention is associated with a respective fluid-powered cylinder for each pusher head. Although pneumatic cylinders can be used, according to the invention hydraulic ones are used that are pressurized with the same oil that is sprayed as cutting oil on the cam surface.

Furthermore in accordance with the invention each cylinder has a pair of parallel chambers each centered on a respective chamber axis lying in a plane parallel to or including the camshaft axis. The heads each have a pair of plungers each slidable in a respective one of the chambers.

Each pusher head can have a cylindrical head surface centered on a respective head axis lying in a plane parallel to or including the camshaft axis. Alternately it can be formed as a bar with rounded corners. When a cylindrical shape is used each pusher head can be a roller rotatable about the respective head axis. With the rounded-bar configuration it can rock about the respective head axis.

In accordance with the invention two such supports diametrally flank the surface and each carry a respective plurality of such pusher heads. The pusher axis of each head of one of the supports is coaxial with the pusher axis of a respective head of the other support. More particularly each head carries three such heads including a center head and two side heads symmetrically flanking the respective center head, all the pusher axes lying in a plane perpendicular to the camshaft axis.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
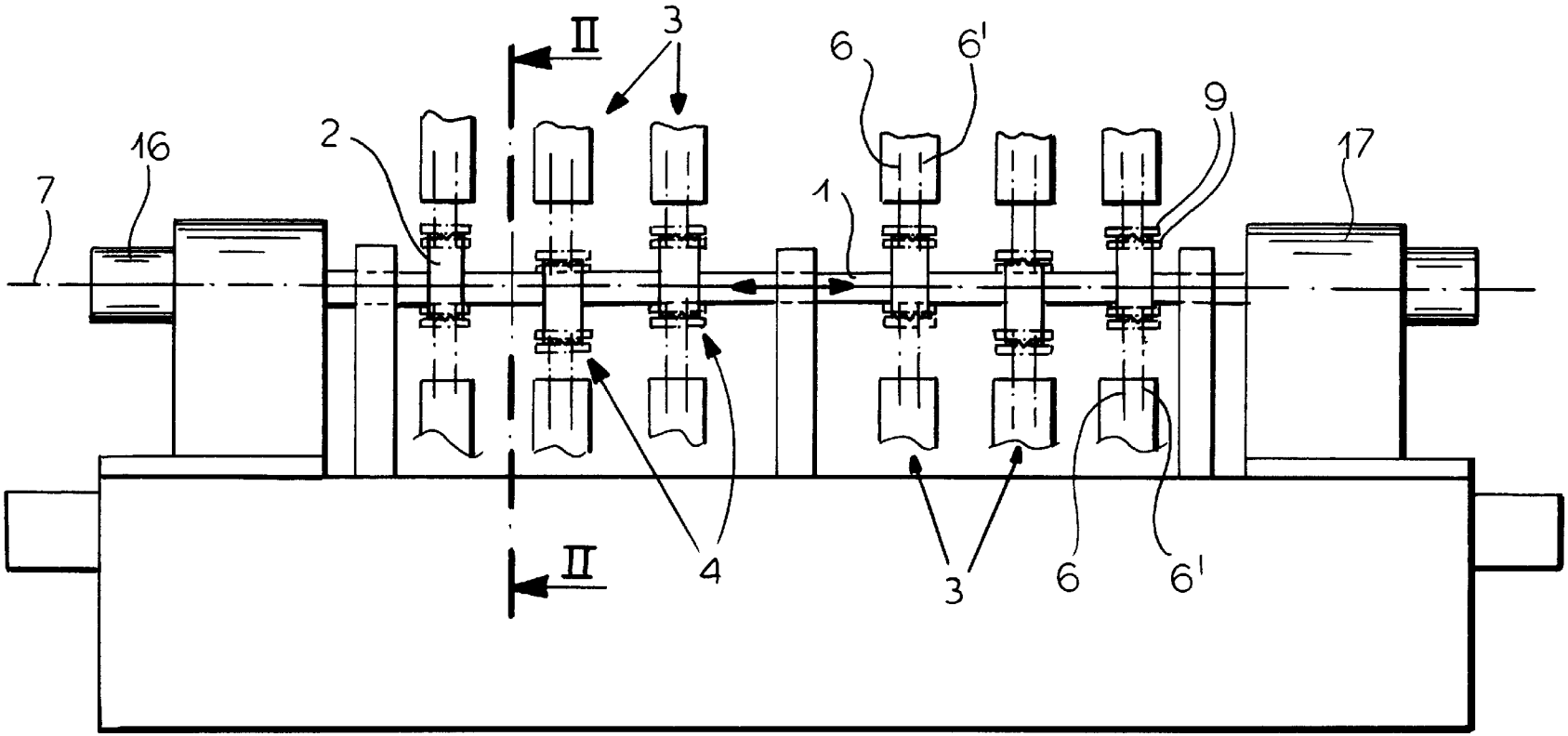
FIG. 1 is a partly diagrammatic side view of the microfinishing apparatus according to the invention.
Figure 2:
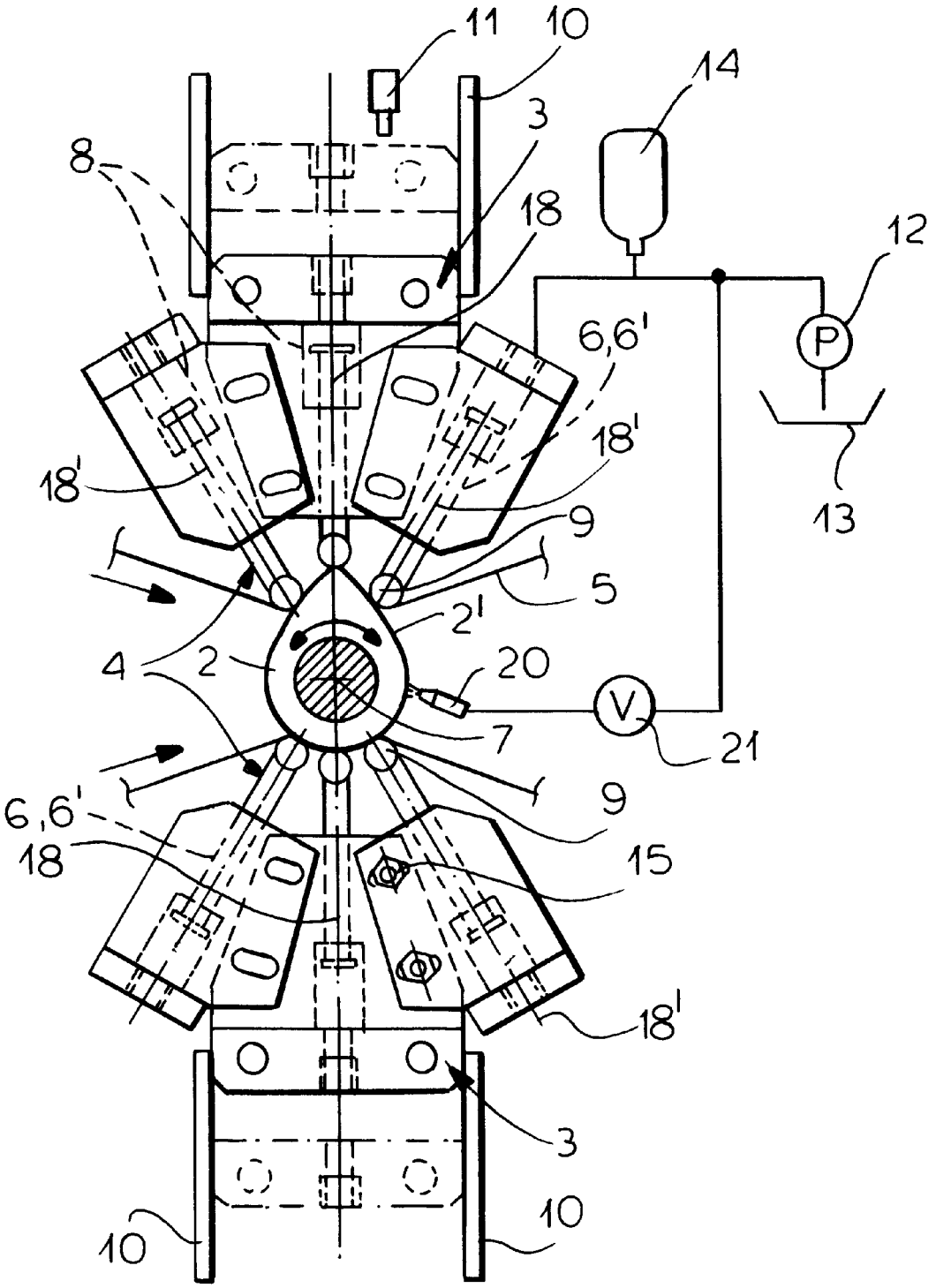
FIG. 2 is a larger scale partly diagrammatic section taken along line II—II of FIG. 1.

As seen in FIGS. 1 and 2, a crankshaft 1 centered on an axis 7 is held in a lathe-like machine 17 and is rotated by a motor 16 about this axis 7 and may be simultaneously reciprocated by the machine 17 through a short stroke parallel to this axis 7. Cams 2 on the shaft 1 have outer surfaces 2' that are not wholly centered on the axis A, having raised lift points as is standard. These surfaces 2' need to be microfinished or honed to a very smooth finish.

To this end above and below each cam 2 is a support 3 movable vertically by a respective actuator 11 in a vertical guide 10. Each such support 3 carries three pusher units 4 carrying respective pusher heads 9 that can be pressed along respective axes 18 against the outer cam surface 2'. Normally a strip 5 of abrasive paper is interposed between the pusher heads 9 and the cam surface 2' and this strip 5 is advanced periodically so that a fresh abrasive portion can be juxtaposed between each pusher head 9 and the cam surface 2' when the portion being used gets too smooth. It is also possible for the pusher heads 9 to be formed as honing stones.

The pusher units 4 each comprise cylinders 8 having axes 18, 18' that include a vertical center axis 18 and two side axes 18' that symmetrically flank it, and the axes 18, 18' of the lower head 3 are similarly arrayed. Thus each lower axis 18, 18' is exactly coaxial with one of the upper axes 18, 18' and all the axes 18 and 18' meet at the axis 7. Thus radial forces on the shaft 2 are perfectly balanced.

The cylinders 8 are all identically pressurized from a pump 12 connected to a fluid supply 13 and provided with a pressure accumulator 14 that ensures that the pressure in all the cylinders 8 is identical. Since these cylinders 8 are all also identical and the pressure elements 9 are identical, this further guarantees that pressure remains balanced. In addition the output of this pump 12 is connected through a valve 21 to a nozzle 20 at each cam 2 so as to spray the surface thereof with cutting oil to cool the surfaces and carry off any particles. Thus the same liquid is used for the cylinders 8 as is used on the surfaces 2' being machined so any leakage from the cylinders 8 will not be a problem.

Figure 3D:
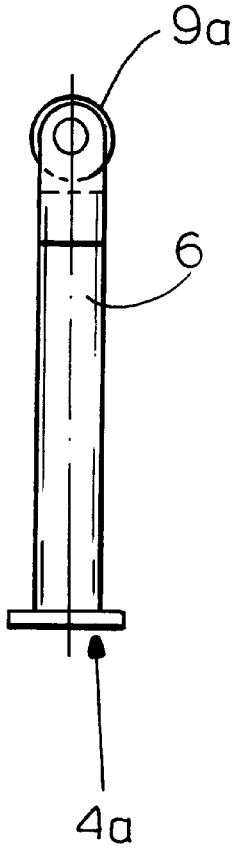
FIGS. 3*c* and 3*d.
Figure 3C:
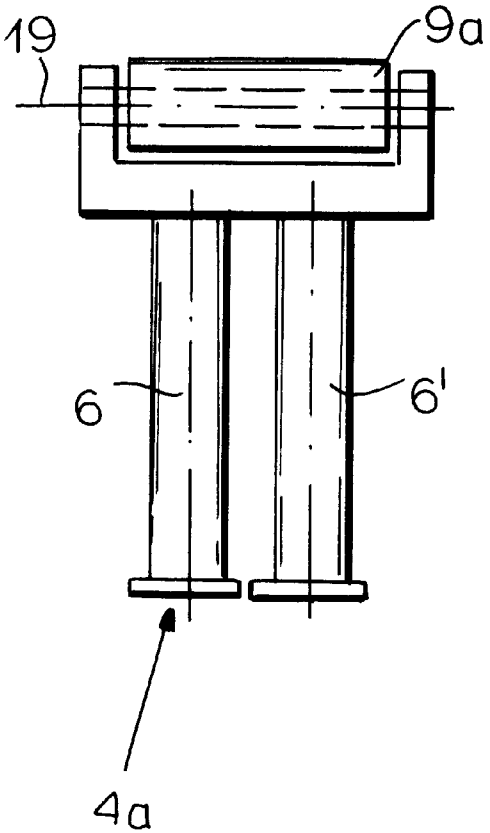
Figure 3B:
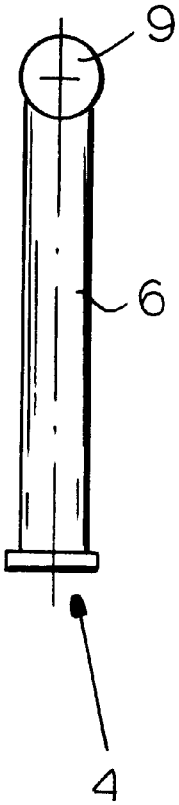
FIGS. 3*a* and 3*b* are front and side views of a pusher unit of the apparatus of FIGS. 1 and 2.
Figure 3A:
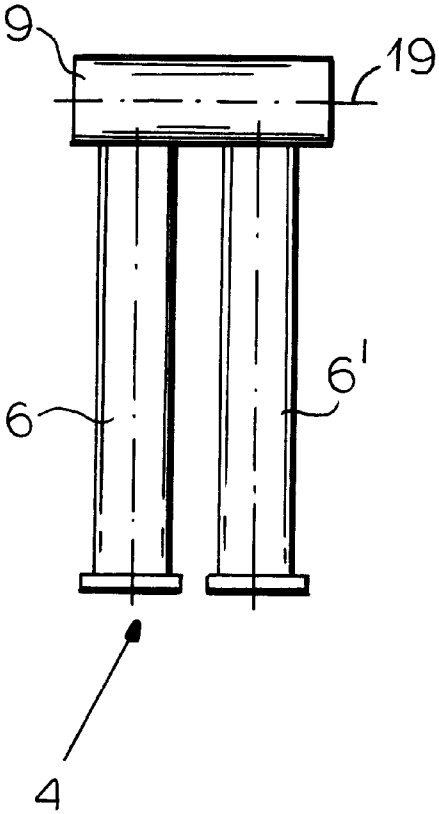
Figure 3H:
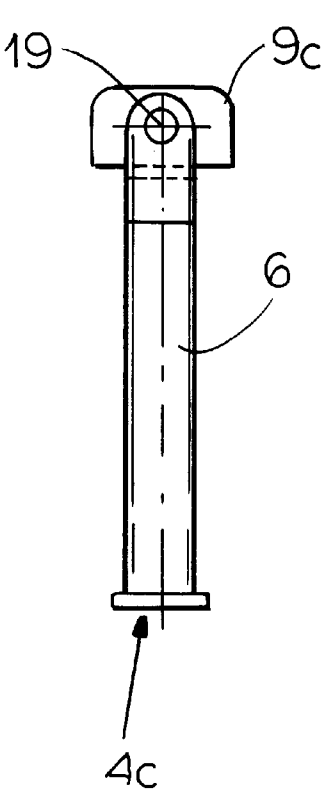
* and FIGS. 3*g* and 3*h* are front and side views of three further pusher units according to the invention.
Figure 3G:
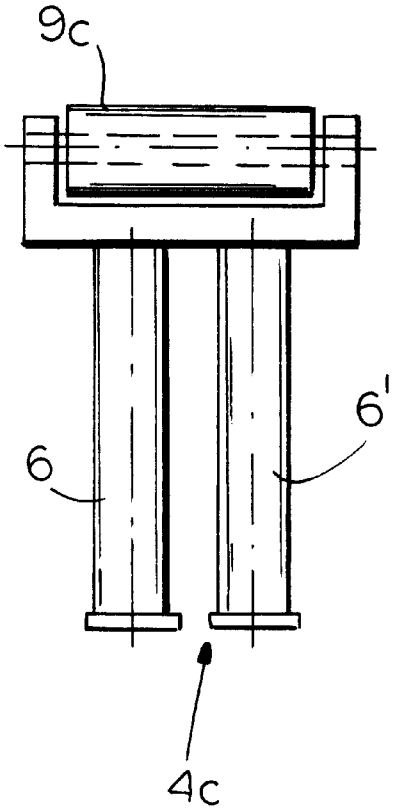

As shown in FIGS. 3*a*–3*h* the pusher unit 4 has a cylindrical pusher head 9 having an axis 19 parallel to the axis 7. As shown in FIGS. 3*a* and 3*b* two identical cylindrical plunger legs 6 and 6' that are parallel to each other and spaced apart along the axis 7 extend radially from the element 9, so that the axis 19 remains perfectly parallel to the axis 7. These plunger legs 6 and 6' are received in respective chambers of the respective cylinder 8, the chambers being centered on respective chamber axes lying in a plane perpendicular to the axis 7 and both parallel to and symmetrically flanking the respective head axis 18 or 18'.

Figure 3F:
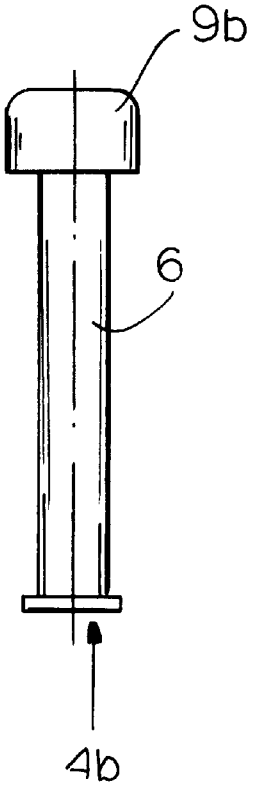
* FIGS. 3*e* and 3*f.
Figure 3E:
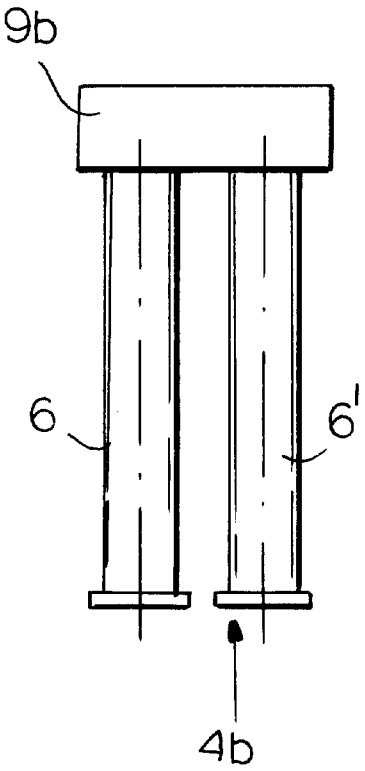

FIGS. 3*c* and 3*d* show a similar unit 4*a* but where the pusher head is formed as a roller 9*a* rotatable about the axis 19. In FIGS. 3*e* and 3*f* the pusher head 9*b* of the unit 4*b* is formed as a rectangular-section bar with rounded corners, while in FIGS. 3*g* and 3*h* the same sectional shape is used for the unit 4*c* but the element 9*c* can rock about the axis 19.

We claim:

1. An apparatus for finishing a surface of a camshaft extending along a shaft axis with the surface offset from the shaft axis, the apparatus comprising:

drive means for rotating the camshaft about the shaft axis;

a support displaceable radially of the shaft axis and forming a plurality of pairs of chambers each centered on a chamber axis, the chamber axes of each pair being parallel and lying in a respective plane parallel to the shaft axis;

respective pusher heads each having an inner end and a pair of plungers axially slidable in a respective one of the pairs of chambers, the heads being movable independently of each other toward and away from the camshaft relative to the support along respective angularly offset pusher axes extending radially of the camshaft;

an abrasive at the inner ends engageable with the camshaft surface; and biasing means including a constant-pressure source for pressurizing all the chambers with the same pressure and thereby urging all the pusher heads along the respective pusher axes toward the shaft axis with substantially the same force.

2. The camshaft-finishing apparatus defined in claim 1 wherein the drive means also relatively reciprocates the camshaft and the supports axially relative to the camshaft axis.

3. The camshaft-finishing apparatus defined in claim 1 wherein the camshaft has a plurality of such surfaces and the apparatus has for each surface a respective such support each provided with a respective plurality of such pusher heads.

4. The camshaft-finishing apparatus defined in claim 1 wherein the abrasive is formed by an abrasive band extending between the pusher heads and the surface, whereby the heads press the band against the surface.

5. The camshaft-finishing apparatus defined in claim 1 wherein the apparatus has a guide extending radially of the camshaft axis and carrying the support.

6. The camshaft-finishing apparatus defined in claim 1, further comprising means for applying cutting oil to the surfaces, the cylinders each being pressurized with the cutting oil.

7. The camshaft-finishing apparatus defined in claim 1 wherein each pusher head has a cylindrical head surface centered on a respective head axis extending parallel to the camshaft axis and lying in a plane perpendicular to the camshaft axis.

8. The camshaft-finishing apparatus defined in claim 7 wherein each pusher head is a roller rotatable about the respective head axis.

9. The camshaft-finishing apparatus defined in claim 1 wherein two such supports diametrally flank the surface and each carry a respective plurality of such pusher heads.

10. The camshaft-finishing apparatus defined in claim 9 wherein the pusher axis of each head of one of the supports is coaxial with the pusher axis of a respective head of the other support.

11. The camshaft-finishing apparatus defined in claim 10 wherein each support carries three such heads including a center head and two side heads symmetrically flanking the respective center head, all the pusher axes lying in a plane perpendicular to the camshaft axis.

* * * * *